US007451770B2

(12) United States Patent
Saito et al.

(10) Patent No.: US 7,451,770 B2
(45) Date of Patent: Nov. 18, 2008

(54) CLEANING DEVICE FOR AN ELECTRICAL HAIR REMOVING APPARATUS

(75) Inventors: Atsuhiro Saito, Hikone (JP); Hiroyuki Kameoka, Hikone (JP); Jyuzaemon Iwasaki, Nagahama (JP); Fumio Taniguchi, Hikone (JP); Yasuo Ibuki, Hikone (JP); Hiroshi Shigeta, Fujiidera (JP)

(73) Assignee: Matsushita Electric Works, Ltd., Osaka (JP)

( * ) Notice: Subject to any disclaimer, the term of this patent is extended or adjusted under 35 U.S.C. 154(b) by 507 days.

(21) Appl. No.: 11/151,268

(22) Filed: Jun. 14, 2005

(65) Prior Publication Data

US 2005/0274402 A1 Dec. 15, 2005

(30) Foreign Application Priority Data

Jun. 14, 2004 (JP) ..... 2004-176182

(51) Int. Cl.
*B08B 3/00* (2006.01)
*B08B 9/00* (2006.01)
*B08B 6/00* (2006.01)

(52) U.S. Cl. ..... 134/92; 134/111; 134/135; 134/166 R; 134/174; 134/183; 134/186

(58) Field of Classification Search ..... 134/11, 134/92, 111, 135, 166 R, 174, 183, 186
See application file for complete search history.

(56) References Cited

U.S. PATENT DOCUMENTS 5,614,030 A * 3/1997 Braun ..... 134/22.1

(Continued)

FOREIGN PATENT DOCUMENTS

EP 0 664 973 A1 1/1995

(Continued)

OTHER PUBLICATIONS

European Search Report dated Nov. 17, 2005.

(Continued)

*Primary Examiner*—Michael Barr
*Assistant Examiner*—Rita R Patel
(74) *Attorney, Agent, or Firm*—Cheng Law Group PLLC

(57) ABSTRACT

A cleaning device for an electrical hair removing apparatus is capable of being stored in a compact profile. The apparatus has an operator head at its top, and is formed on its bottom with an electric terminal for receiving an external signal that controls the apparatus. The cleaning device includes a basin for receiving the operator head of the apparatus and also includes a control circuit providing the external signal. The device has a tank storing a volume of a cleaning liquid, and a circulator configured to supply the cleaning liquid into the basin from the tank for cleaning the operator head. A stand is provided on the device to hold the apparatus upside down with the operator head disposed within the basin. The stand is formed at its top end with a header carrying contacts which are connected to the terminal on the bottom of the apparatus. The stand is composed of a fixed support and a movable arm which extends from the support and is formed at its top with the header. The arm is movable relative to the support between an extended position where the header is around the bottom of the apparatus and a retracted position where the header is lowered than at the extended position in the absence of the apparatus. Accordingly, the whole height of the stand can be reduced when the apparatus is detached from the device so that the device can be made into a low profile structure sufficient to be stored in compact.

5 Claims, 11 Drawing Sheets

U.S. PATENT DOCUMENTS

| | | | | |
|---|---|---|---|---|
| 5,649,556 | A * | 7/1997 | Braun | 134/92 |
| 5,711,328 | A | 1/1998 | Braun | |
| 6,263,890 | B1 | 7/2001 | Höser | |
| 6,305,391 | B1 * | 10/2001 | Hoser | 134/111 |
| 6,371,136 | B1 * | 4/2002 | Hoser | 134/111 |
| 6,640,819 | B2 * | 11/2003 | Hoser et al. | 134/92 |
| 6,698,437 | B2 * | 3/2004 | Hoser et al. | 134/104.4 |
| 7,002,091 | B2 * | 2/2006 | Hoser et al. | 200/520 |
| 7,059,336 | B2 * | 6/2006 | Hoser et al. | 134/92 |
| 7,143,517 | B2 * | 12/2006 | Kappes et al. | 30/538 |
| 7,225,817 | B2 * | 6/2007 | Eichhorn et al. | 134/105 |
| 7,316,236 | B2 * | 1/2008 | Hoser | 134/166 R |
| 2002/0069902 | A1 | 6/2002 | Hoser et al. | |

FOREIGN PATENT DOCUMENTS

| | | | |
|---|---|---|---|
| JP | 04-069030 | U | 6/1992 |
| JP | 06-312767 | A | 11/1994 |
| JP | 11-192389 | A | 7/1999 |
| JP | 2000-084271 | A | 3/2000 |

OTHER PUBLICATIONS

JPO Notification of Reasons for Refusal for the Application No. 2004-176182, mailed on Aug. 15, 2007.

Decision of Refusal for the Application No. 2004-176182 from Japan Patent Office, mailed Feb. 5, 2008.

* cited by examiner

CLEANING DEVICE FOR AN ELECTRICAL HAIR REMOVING APPARATUS

FIELD OF THE INVENTION

The present invention is directed to a cleaning device for a hair removing apparatus, and more particularly such cleaning device provided with a stand for transmitting an electric signal to the hair removing apparatus while cleaning the apparatus with the use of a cleaning liquid.

BACKGROUND ART

EP 0 664 973 A1 discloses a cleaning device for a dry shaver. The device is formed with a basin for receiving therein a shaver head of the shaver, and a tank storing a volume of a cleaning liquid which is circulated between the tank and the basin for cleaning the shaver head, i.e., cutters and the associated parts. The dry shaver is elongated in shape to have the shaver head at its top end and an electric terminal at its bottom end. The device includes a stand which holds the shaver upside down to place the shaving head placed in the basin. The electric terminal on the bottom of the shaver is designed to receive an electric signal from a control circuit within the device for controlling the shaver while it is held by the stand. The stand includes a header carrying contacts and extending over the bottom of the shaver held upside down to mate the contacts with the terminals for electrical connection therebetween. With this structure, the header adds an extra height dimension to the device, which becomes hindrance when the device is put aside with the shaver detached therefrom, thereby detracting from the compactness of the device in its stored condition.

DISCLOSURE OF THE INVENTION

In view of the above insufficiency, the present invention has been accomplished to provide a cleaning device which is capable of being stored in a compact profile. The cleaning device in accordance with the present invention is designed for an electrical hair removing apparatus which has an operator head at its top and is formed on its bottom with an electric terminal for receiving an external signal that controls the apparatus. The cleaning device includes a housing which is provided with a basin for receiving the operator head of the apparatus and accommodates therein a control circuit providing the external signal. The device also includes a tank storing a volume of a cleaning liquid, and a circulator configured to supply the cleaning liquid into the basin from the tank for cleaning the operator head and to recover the liquid from the basin back into the tank. A stand is provided on the housing to hold the apparatus upside down with the operator head disposed within the basin. The stand is formed at its top end with a header carrying a contact which comes into contact with the terminal on the bottom of the apparatus. The feature of the present invention resides in that the stand is composed of a fixed support upstanding from the housing and a movable arm which extends from the support and is formed at its top with the header. The movable arm is movable relative to the support between an extended position where the header is around the bottom of the apparatus held upside down and a retracted position where the header is lowered than at the extended position in the absence of the apparatus. Accordingly, the whole height of the stand can be reduced when the apparatus is detached from the device so that the device can be made into a low profile structure sufficient to be stored in compact.

The movable arm may be slidable along an axis of the support or pivotally supported to the support so as to pivot about a horizontal axis.

These and still other advantageous features of the present invention will become more apparent from the following detailed description of the preferred embodiment when taken in conjunction with the attached drawings.

BEST MODE FOR CARRYING OUT THE INVENTION

Figure 1:
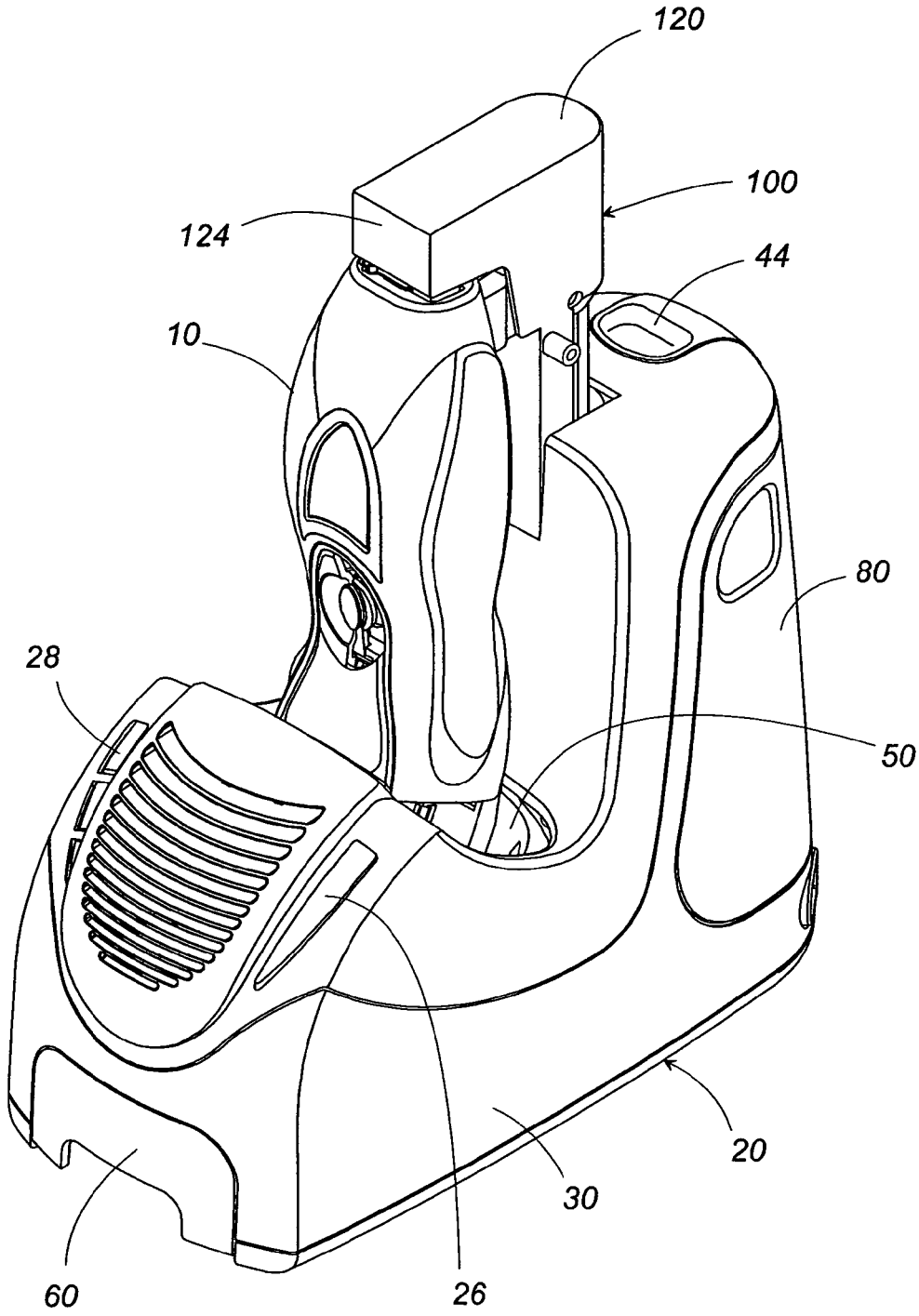
FIG. 1 is a perspective view of a cleaning device in accordance with a preferred embodiment of the present invention.
Figure 2:
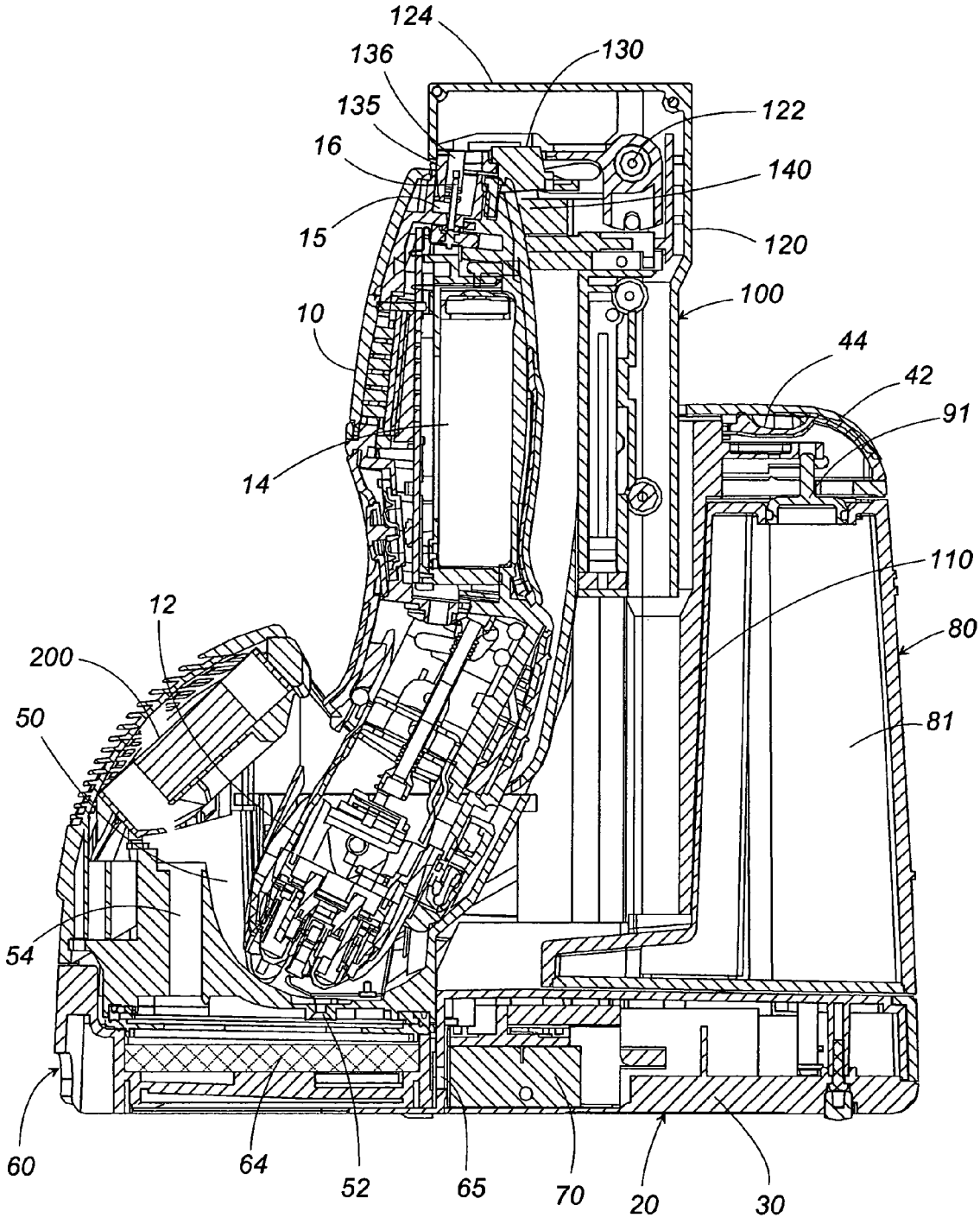
FIG. 2 is a vertical section of the cleaning device.
Figure 3:
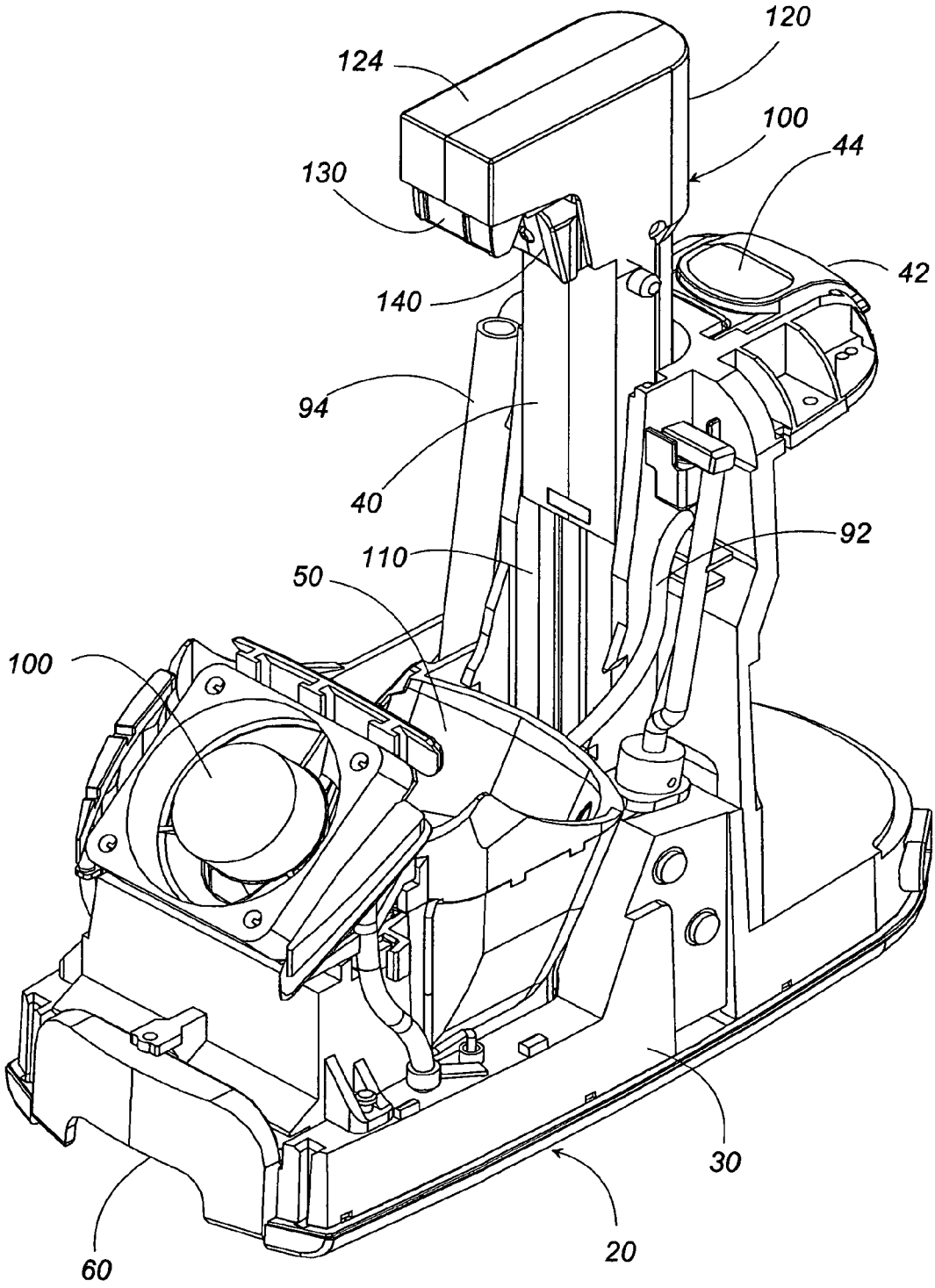
FIG. 3 is a perspective view of the cleaning device with a portion thereof cut away.

Referring now to FIGS. 1 to 3, there is shown a cleaning device for cleaning a hair removing apparatus, for example, a dry shaver 10 or epilator with the use of a cleaning liquid. The cleaning liquid is composed of a solution, for example, water and a solute dissolved in the solution for enhancing the cleaning effect. The dry shaver is of a vertically elongated configuration having an operator head, i.e., shaving head 12 on its top and having a rechargeable battery 14 which energizes an incorporated motor for driving the shaving head. The shaver 10 is formed in its bottom with a recess 15 within which the an electric terminal 16 projects for receiving an external electric signal of charging the battery and/or driving the shaving head 12. An electric circuit is included in the dry shaver 10 to charge the battery 14 and drive the operator head 12 upon receiving the electric signal.

The device has a housing 20 with a base 30 and a stand 100 upstanding from the base to hold the shaver 10 upside down. Formed at the front end of the base 30 is a basin 50 which is configured to receive an operator head, i.e., a shaver head 12 of the shaver 10. The cleaning liquid is stored in a tank 80 which is detachably mounted to the rear end of the housing 20 behind the stand 100 and is connected to the basin 50 to supply the cleaning liquid into the basin 50 for cleaning the shaving head 12 and to recover the liquid therefrom. The device includes a pump 70 which is cooperative with the tank 80 to define a circulator responsible for circulating the cleaning liquid between the tank 80 and the basin 50. The pump 70 is controlled to continue the cleaning operation for a predetermined period. Thereafter, a control is made to recover the liquid from the basin 50 into the tank 80, details of which will be discussed later. Upon recovery of the liquid into the tank, a fan 200 is actuated to produce a forced air flow over the head 12 for drying the same. Initially, the tank 80 is filled with the solution into which the solute is replenished while the solution is forced to circulate between the basin 50 and the tank 80.

Figure 4:
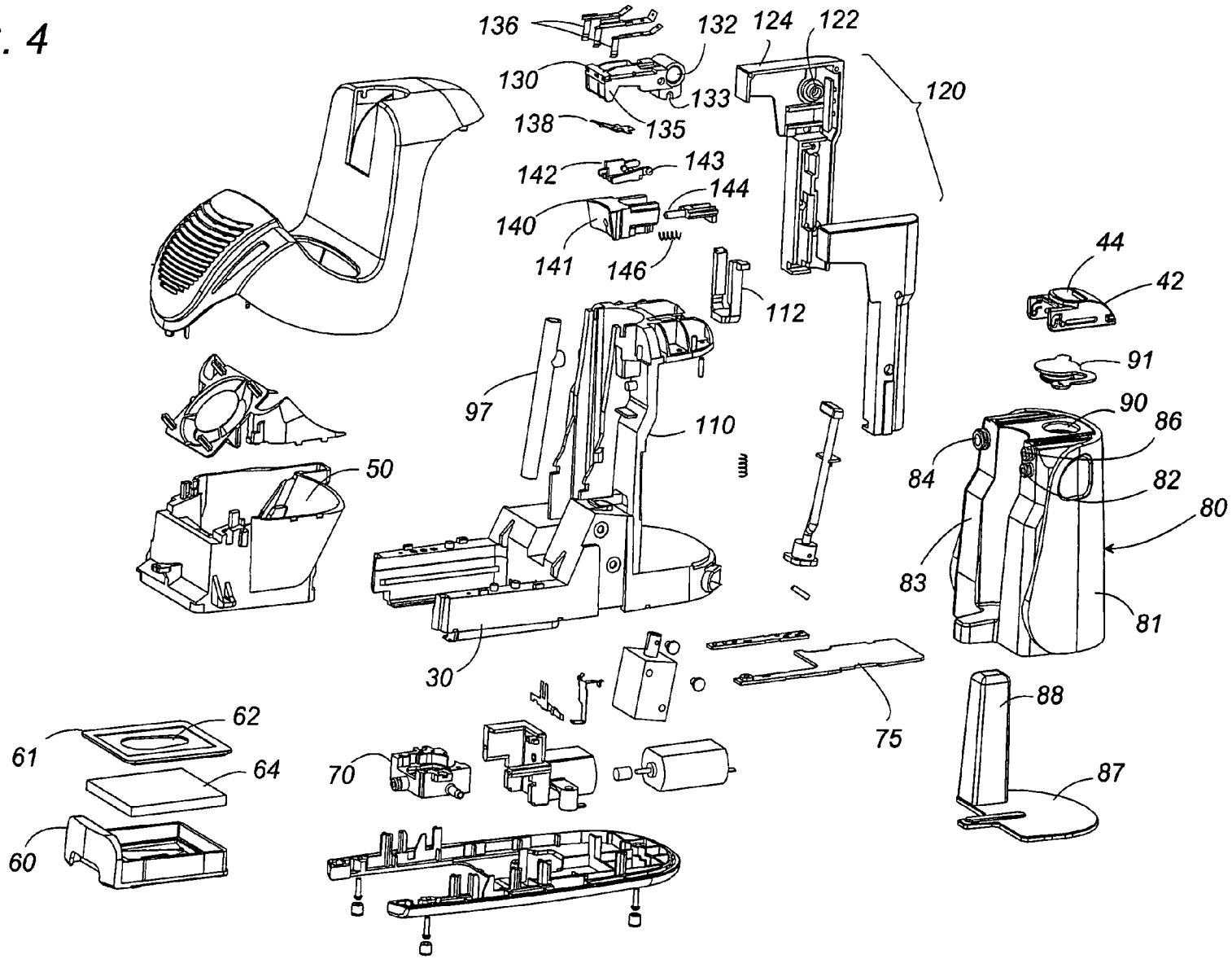
FIG. 4 is an exploded perspective view of the cleaning device.

As shown in FIG. 2, a container 60 is disposed immediately below the basin 50 for collecting the liquid dripping and/or overflowing from the basin 50. The container 60 is configured as a removable drawer pan inserted in the front bottom of the housing 20 and is configured to hold the solute which is exposed to the solution or the liquid flowing from the basin 50 to be dissolved therein. As best shown in FIG. 4, the container 60 is a top-open rectangular flat box accommodating therein a filter 64 impregnated with the solute. The container 60 includes a lid 61 with a top opening 62 which communicates with a drain port 52 at the bottom center of the basin 50, and also with an overflow duct 54 leading to an upper edge of the basin 50 in order to receive the liquid and/or the solution flowing from the basin 50. The filter 64 is fabricated of fibers into an unwoven fuzzy fabric to soak up the solute as well as to entrap hairs or contaminants dislodged from the shaver head 12 and carried by the liquid dribbling through the drain port 52 towards the container 60. The liquid replenished with the solute and cleared of the contaminants is fed through a connection port 65 in the rear end of the container 60 to a recovery path 22 leading to the tank 80. The container 60 is prepared as a replacement package including the filter 64 for easy maintenance of the device.

As schematically shown in FIG, 5 the pump 70 is disposed in the recovery path 22 for drawing the liquid from the basin 50. The recovery path 22 is open to the atmosphere through the drain port 52 and the overflow duct 54. Thus, depending upon the level of the liquid in the basin 50, the outside air is drawn alone or together with the liquid by the action of the pump 70 into the tank 80 through the recovery path 22.

The tank 80 is divided into a hermetically sealed pressure chamber 81 and an open-air liquid dispensing chamber 83 which communicates with each other through a bottom channel 85. A dummy projection 88 projects from a bottom plate 87 of the tank into the liquid dispensing chamber 83 to differentiate capacities of the chambers so that the liquid dispensing chamber 83 is given less capacity than the pressure chamber 81, as schematically shown in FIGS. 5A to 5E. The pressure chamber 81 is provided at its upper end with an inlet 82 connected to the recovery path 22 for receiving the liquid and/or the air. Also provided at the upper end of the pressure chamber 81 is an air vent 86 to selectively open the chamber to the atmosphere. The liquid dispensing chamber 83 is formed at its upper end with an outlet 84 which is connected to a liquid supply path 24 for feeding the liquid out of the tank 80 into the basin 50. The solution is initially stored into the tank 80 through a filling port 90 which is formed at the top of the pressure chamber 81 and is hermetically sealed by a cap 91. When the tank 80 is attached to the housing 20, a knob 44 at a rear extension 42 of the stand 100 presses the cap 91 to keep it closed.

As shown in FIG. 3, a portion of the recovery path 22 leading from the pump 70 to the tank 80 is defined by a tube 92. Likewise, the supply path 24 is defined by a tube 94. The tubes 92 and 94 terminate respectively at ports (not shown) formed on the side of the stand 100 for detachable connection with the inlet 82 and the outlet 84 of the tank 80. An open port (not shown) is provided also on the side of the stand 100 for detachable connection with the air vent 86 for communicating the air vent with the atmosphere. The open port includes a valve 46 which is controlled to open and close the air vent 86 selectively.

Figure 5A:
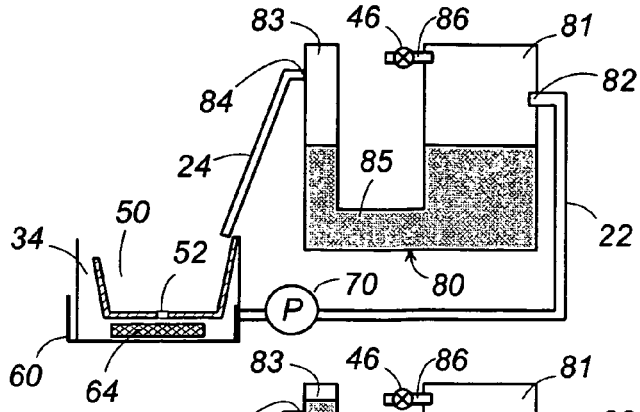
FIGS. 5A to 5E are schematic views illustrating the operation of the cleaning device.
Figure 5B:
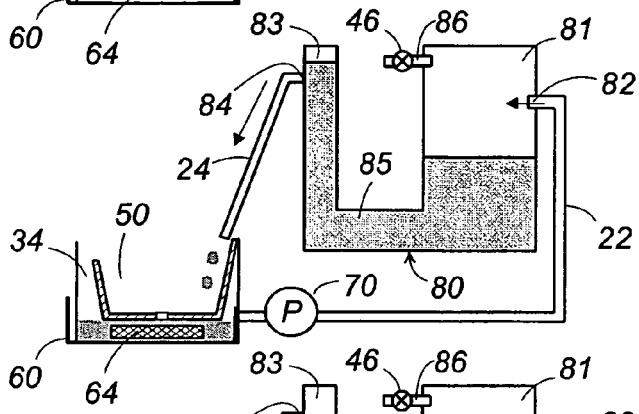
Figure 5C:
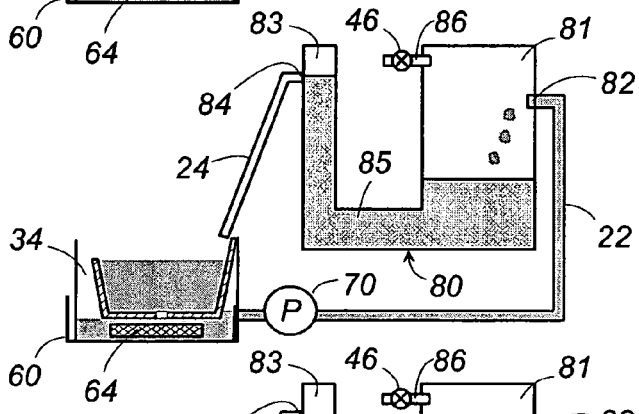
Figure 5D:
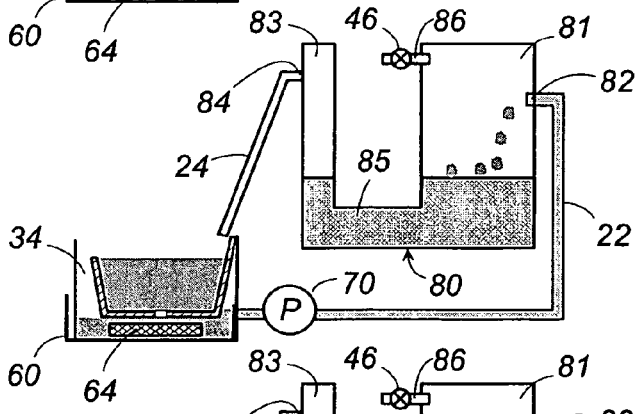
Figure 5E:
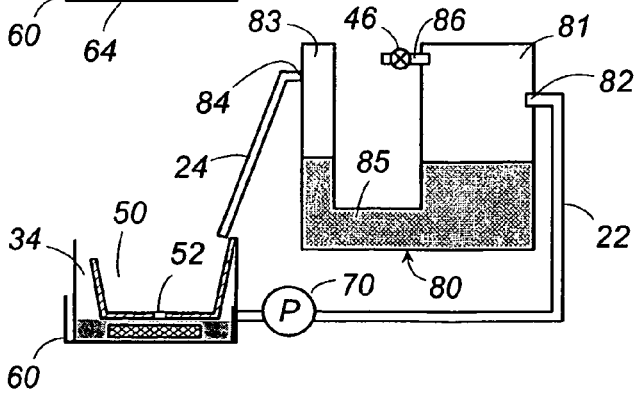

Now, the operation of the device is discussed with reference to FIGS. 5A to 5E. The device includes a controller for control of the pump 70 in combination with the valve 46 of the air vent 86. At a starting condition of FIG. 5A, only the tank 80 is filled with the solution or the cleaning liquid with the air vent 86 being kept open to the atmosphere. When a switch button 26 at the front end of the housing 20 is pressed, the controller activates the pump 70 and at the same time closes the valve 46 to make the pressure chamber 81 hermetically closed. In this condition, the pump 70 draws the outside air through the container 60 and the recovery path 22, building up the air pressure within the chamber 81, which in turn rises the liquid level within the dispensing chamber 83 above the outlet 84, as shown in FIG. 5B. Thus, the liquid begins flowing out of the outlet 84 into the basin 50 through the supply path 24. This continues until the basin 50 is filled with a sufficient amount of the liquid, as shown in FIG. 5C, after which the pump 70 draws the liquid instead of the air to circulate the liquid between the tank 80 and the basin 50 to maintain the liquid level of the basin at a constant level for cleaning the shaving head 12. When the controller acknowledges an elapse of a predetermined time indicative of the cleaning time, it activates the valve 46 to open, thereby lowering the liquid level of the dispensing chamber 83 below the outlet 24 to stop supplying the liquid to basin 50, as shown in FIG. 5D, while the pump 70 continues to draw the liquid from the basin to the tank 80. When the basin 50 becomes empty, which is acknowledged by the controller in combination with a level sensor 55 located in the basin 50, the pump 70 is deactivated with the valve 46 kept opened, as shown in FIG. 5E, to terminate the recovery of the liquid. Since the air vent 86 is kept opened except during the circulation of the liquid, the liquid level can be kept lower than the outlet 24 so as not to dispense the liquid out of the tank 80 in that condition.

Figure 6:
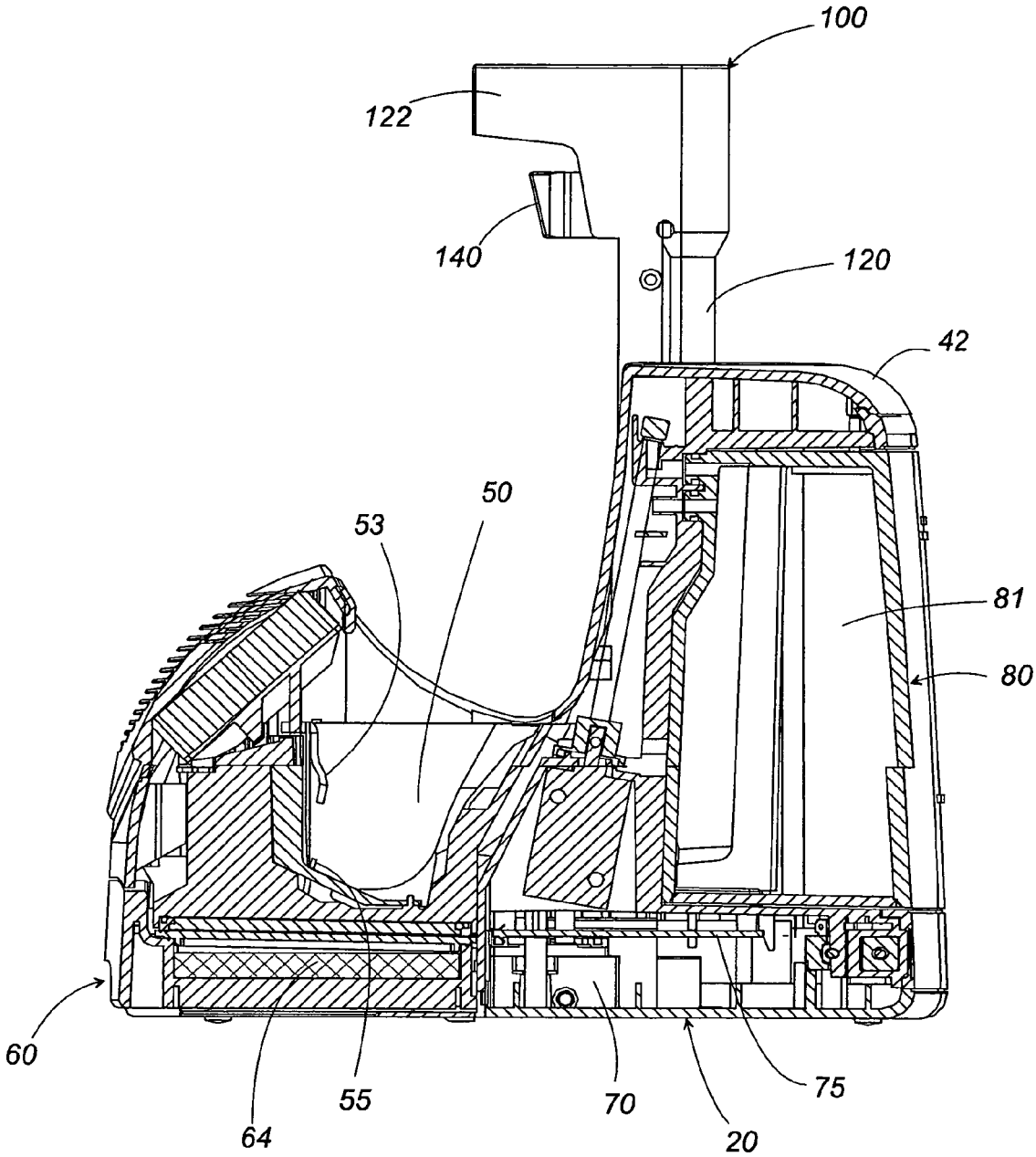
FIG. 6 is a vertical section of the cleaning device with its stand in an extended position.

During the circulation of the liquid, the solute in the container 60 is replenished into the liquid or the solution to give a sufficient concentration of the solute for maximum cleaning effect. It is noted in this connection that the controller is also configured to activate the shaving head intermittently or continuously to shake the contaminations off for enhanced cleaning effect, while the liquid level of the basin 50 is above a predetermined level as monitored by a level sensor 53, as shown in FIG. 6. In this connection, the stand 100 is provided with contacts 136 which come into contact with corresponding terminals 16 of the shaver 10 for driving the shaving head 12 and/or charging the battery 14. In this connection, the housing 20 incorporates a circuit board 75 mounting electrical components to provide a control circuit for generating the signal to be transmitted to the shaver 10 through the contacts 136 and the terminals 16.

Figure 11:
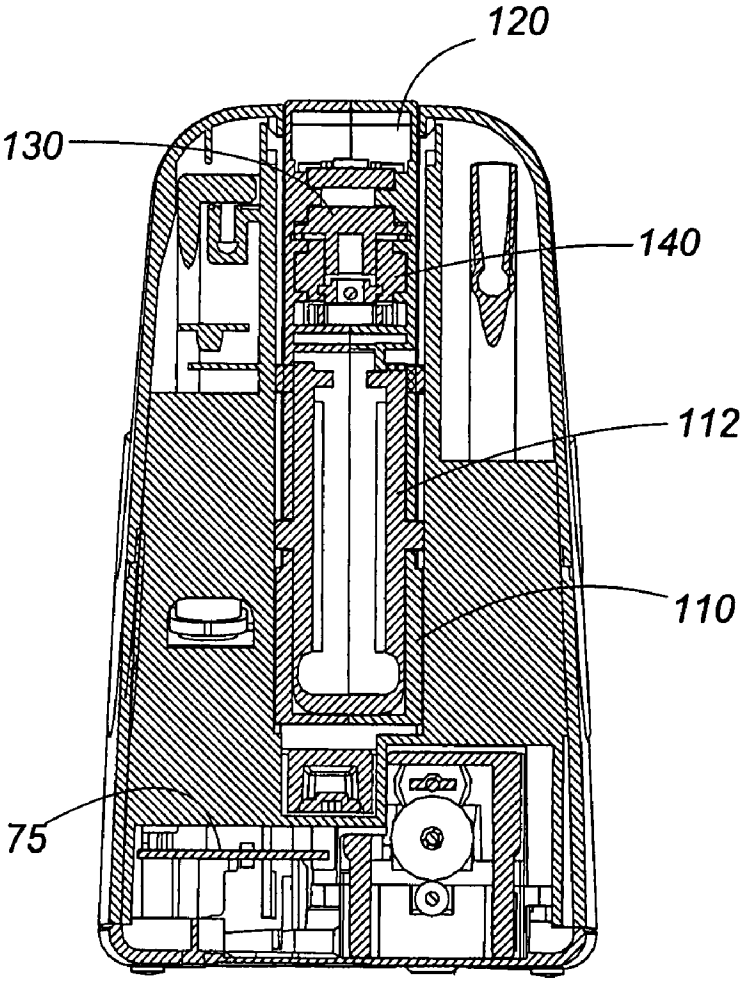
FIGS. 10 and 11 are respectively a side view and a vertical side section of the cleaning device with the stand in the retracted position.

As shown in FIGS. 2 to 4, the stand 100 is composed of a fixed support 110 upstanding from the base 20 and a movable arm 120 which extends from the support 110 and is formed at its upper end with a header 130 carrying the contacts 136. The movable arm 120 is slidably connected to the support 110 to move along an upright axis of thereof between an extended position of FIGS. 2, 6 to 8, and a retracted position of FIGS. 9 to 11. It is the extended position at which the shaver 10 is held upside down with the terminals 16 kept in electrical connection with the contacts 136, enabling to charge the battery 14 and/or driving the shaving head 12. When the dry shaver 10 is detached out of the basin 50, i.e., released from the stand 100, the movable arm 120 can be lowered to the retracted position to reduce the height of the stand 100. At the retracted position, the upper end of the movable arm 120 is held in level with the top end of the tank 80 to make the whole device compact. A click spring 112 is provided to click the movable arm 120 into the extended position and the retracted position.

The header 130 carrying the contacts 136 is formed in its rear end with a pivot hole 132 for receiving an axle 122 at the inner end of the arm 120, and is therefore pivotally supported to the arm so as to pivot in a forward direction in response to the dry shaver being mounted to the stand 100, thereby mating the contacts 136 with the terminals 16, as shown in FIG. 2. For this purpose, the header 130 is linked to a catch 140 which is supported to the arm 20 to move back and forth together with an actuator 142. The actuator 142 is formed at its rear end with axles 143 which fit into slots 133 in the rear end of the header 130 so that the rearward movement of the actuator 142, i.e., the catch 140 causes the header 130 to pivot forwardly and downwardly for engagement of the contacts 136 with the terminals 16 on the bottom of the shaver 10. The catch 140 is disposed immediately below the header 130, and has a front concave 141 shaped to fit with a rounded contour of the shaver. The header 130 is formed at its front end with a hook 135 which engages into the recess 15 at the bottom of the shaver 10 so as to lock the shaver on the stand 100, in response to the above pivot movement of the header 130. The header 130 is concealed within a front cover 124 extending from the upper end of the arm 120.

The header 130 carries a switch contact 138 which is closed in response to the pivot movement of the header 130 to give an electric signal indicative of that the shaver is held on the support to the control circuit, enabling to charge the battery and/or driving the shaving head, in addition to enabling the cleaning operation. The catch 140 is normally biased by a spring 146 to project on front of the arm 120, as shown in FIG. 6, and is pressed by the body of the shaver 10 when it is placed upside down against the stand 100. A lock pin 144 is provided to lock the catch 140, i.e., prevent it from moving rearwards in the absence of the shaver. When the shaver 10 is placed against the stand, it pushes to unlock the pin 144, permitting the catch 140 to move rearwards for pivoting the header 130 into engagement with the shaver mechanically and electrically, as explained in the above. The lock pin 144 has its front end projecting on the front concave 141 within a depth of the concave so as not to be accidentally unlocked in the absence of the shaver.

Figure 8:
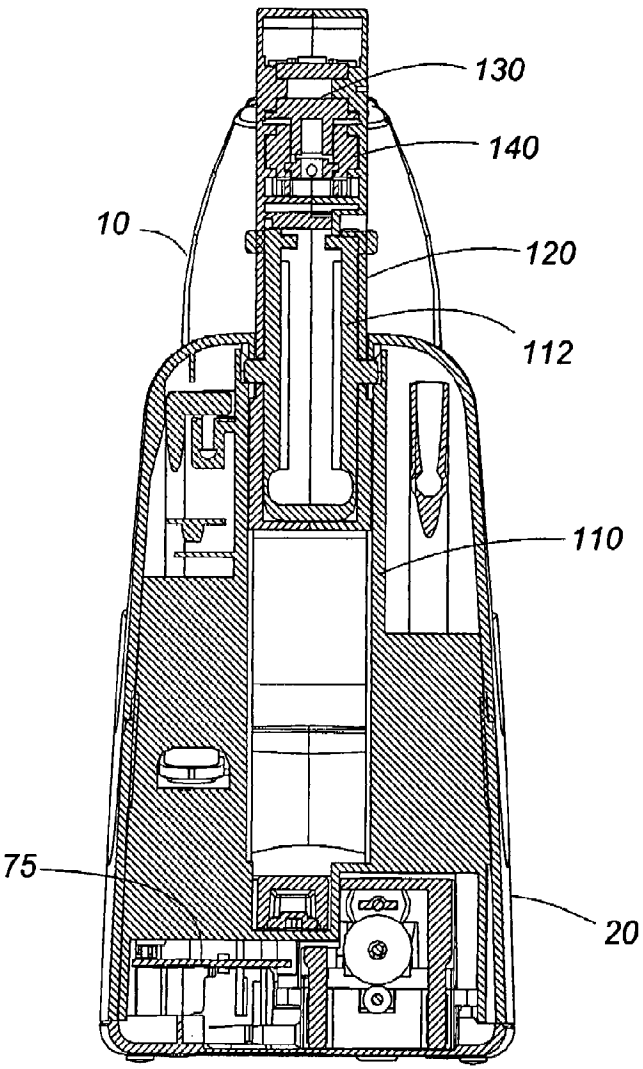
FIGS. 7 and 8 are respectively a side view and a vertical side section of the cleaning device with the stand in the extended position.
Figure 7:
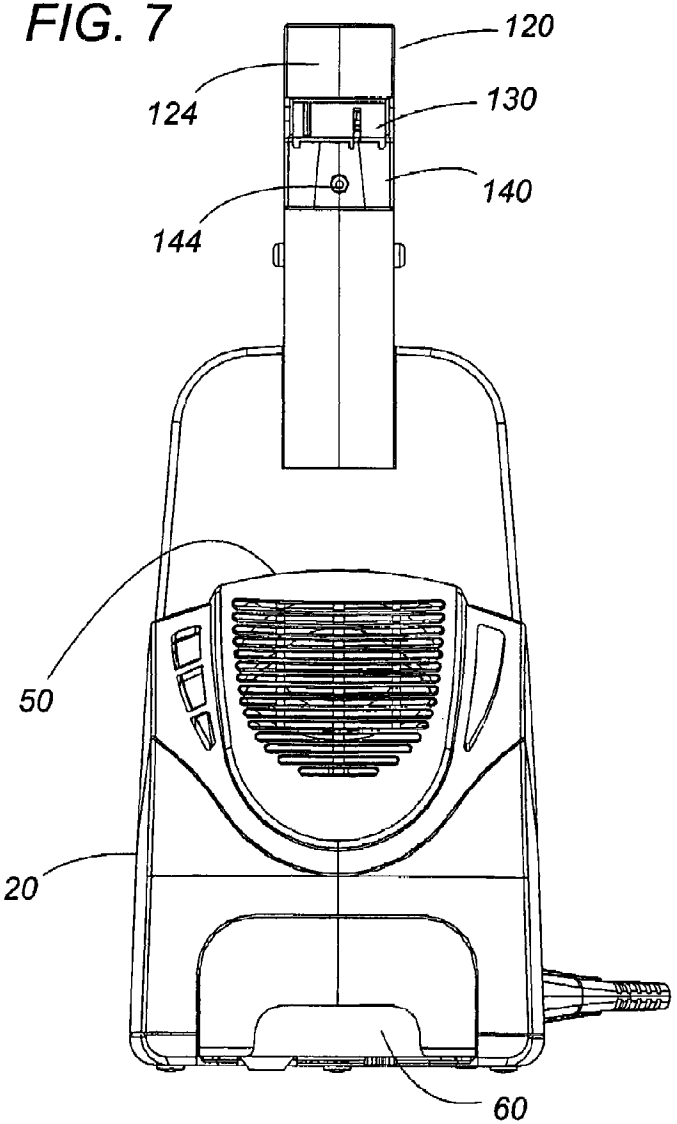
Figure 9:
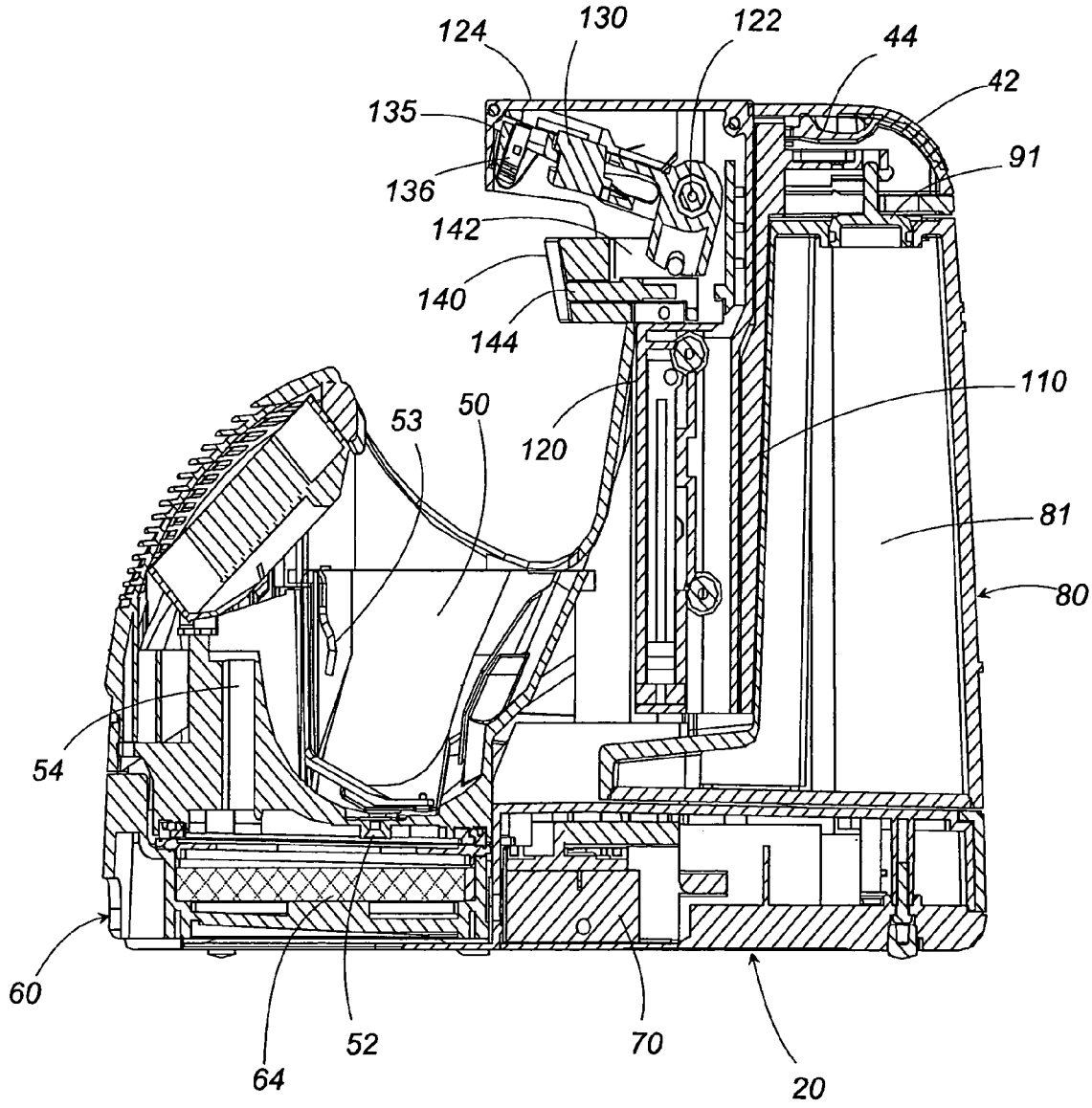
FIG. 9 is a vertical section of the cleaning device with the stand shown in a retracted position.
Figure 10:
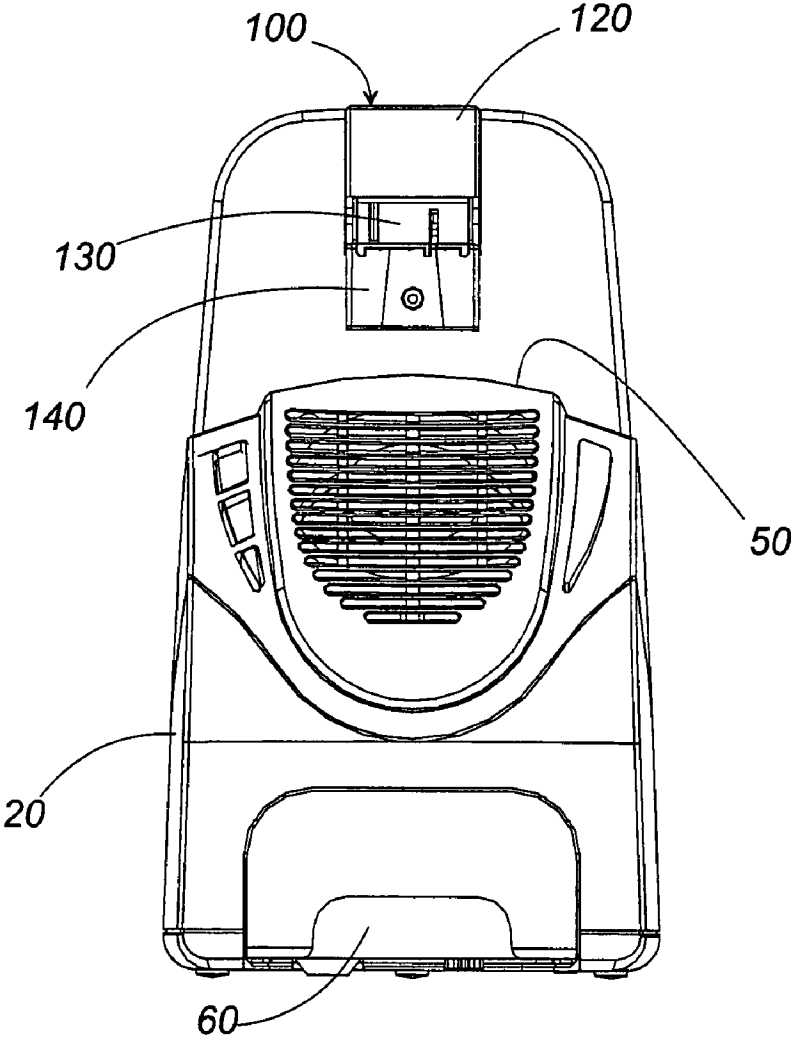

In the absence of the shaver, the header 130 is kept completely within the front cover 124 as a consequence of being pivoted upwardly to conceal the contacts 136 within the front cover 124, as shown in FIGS. 8 and 9. It is noted in this connection that the header 130 of FIGS. 3 and 7 is shown as being pivoted downwardly only for illustration of the header 130.

Figure 12:
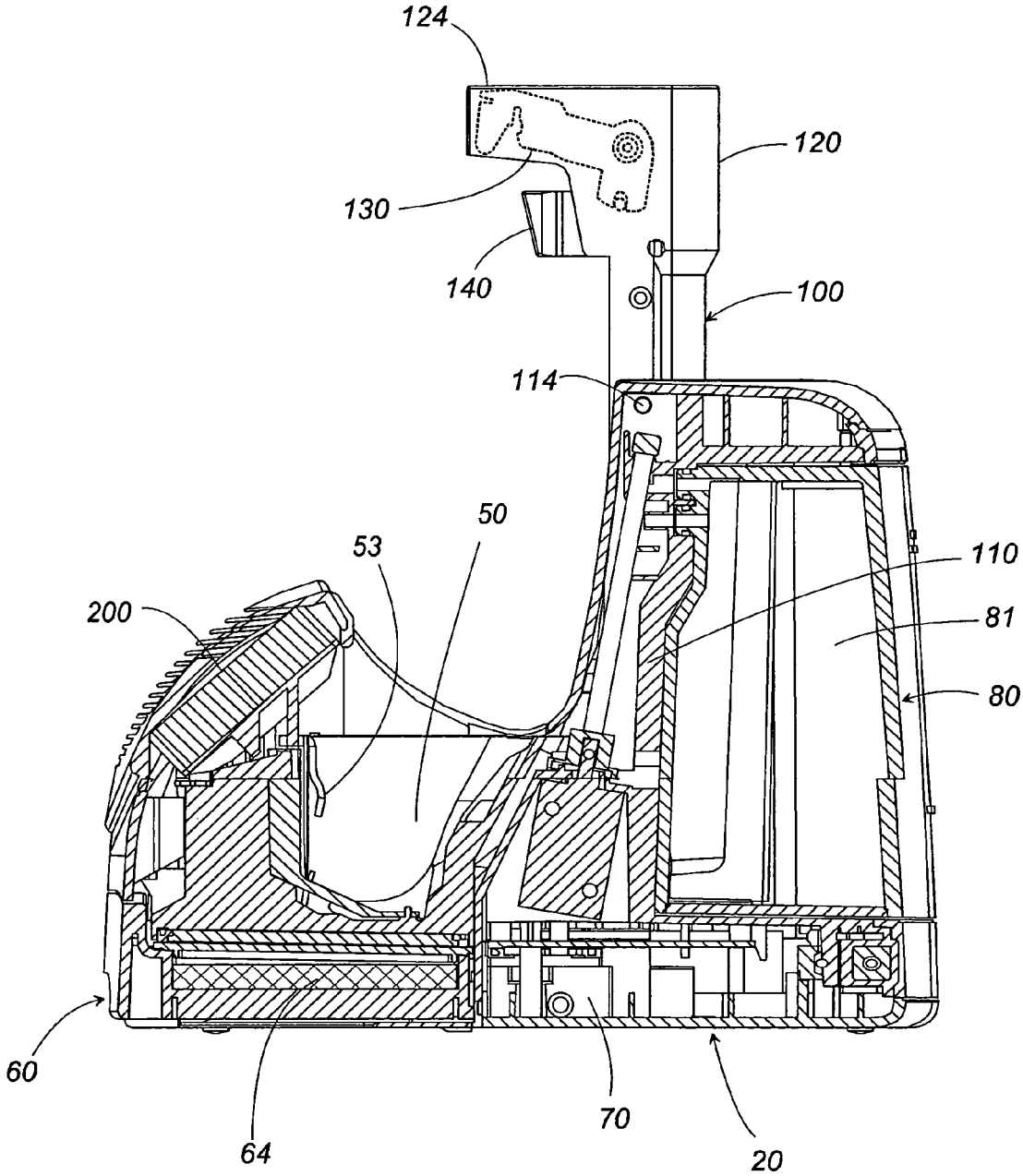
FIGS. 12 and 13 are respectively vertical front section of a cleaning device respectively with the stand in the extended and retracted position in accordance with another preferred embodiment of the present invention.
Figure 13:
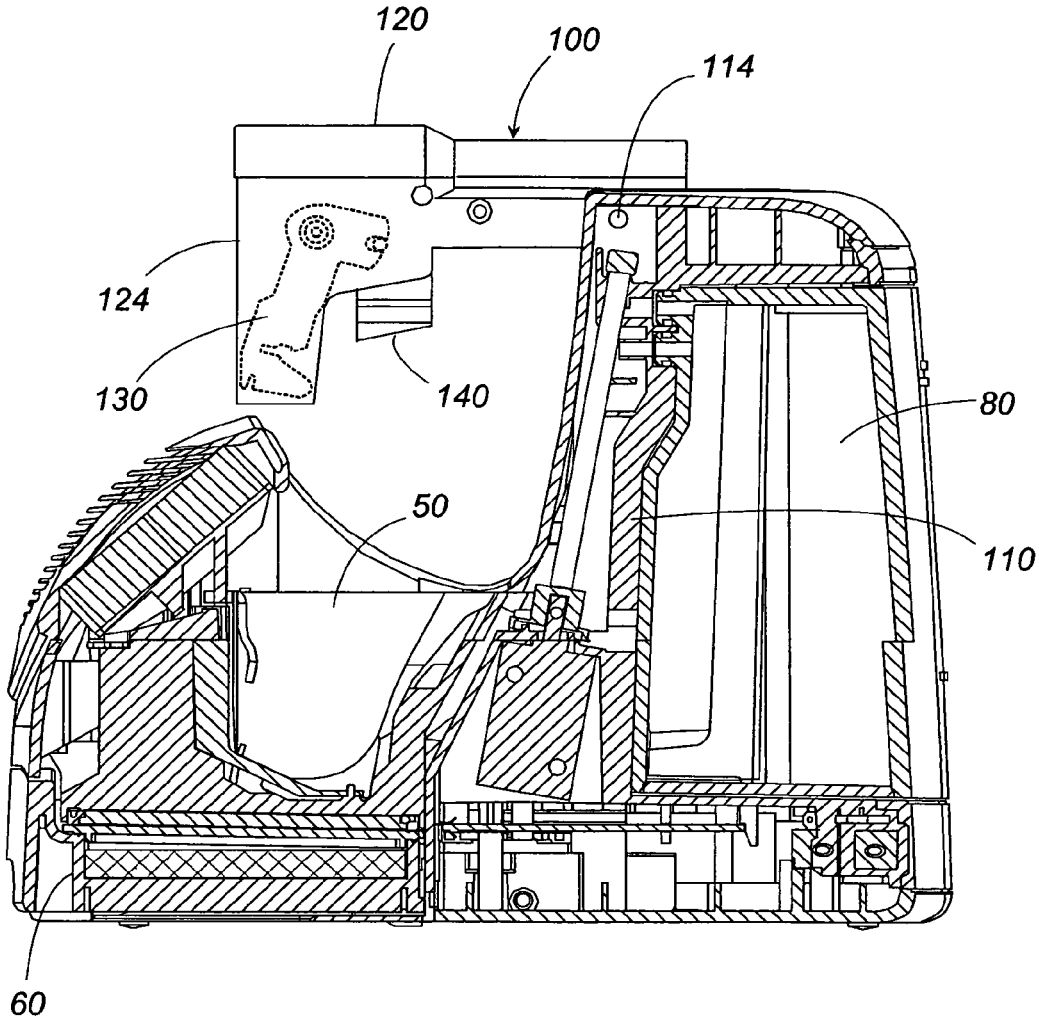

FIGS. 12 and 13 illustrates the like cleaning device in accordance with another preferred embodiment of the present invention which is identical to the above embodiment except that the movable arm 120 is pivotally supported to the fixed support 110 so as to pivot between the extended position of FIG. 12 and the retracted position of FIG. 13. Like parts are designated by like reference numerals. The movable arm 120 is connected at its lower end to the upper end of the fixed support 110 by means of a pivot pin 114 to pivot about a horizontal axis. In the retracted position, the movable arm 120 extends horizontally above the basin 50 to reduce the height of the stand 100 making the device compact enough to be stored conveniently.

The cleaning device in accordance with the present invention can be equally applied for cleaning the epilating head of a hand-held epilator or other operator head of similar hair removing apparatus.

The invention claimed is:

1. A cleaning device with an electric hair removing apparatus having an operator head at its top end, comprising:

a housing having a basin configured to receive the operator head of the apparatus, a tank configured to store a volume of a cleaning liquid:

a circulator configured to supply said cleaning liquid to said basin from said tank for cleaning the operator head and to recover the liquid from the basin back into said tank;

a stand provided on said housing and is configured to hold said apparatus upside down with said operator head disposed within said basin, said stand being composed of a fixed support upstanding from said housing and a movable arm which extends from said support and is formed at its top end with a header, said hair removing apparatus being formed on its bottom with an electric terminal for receiving an external signal that controls said apparatus, said housing accommodating therein a control circuit which provides said external signal;

said header carrying a contact which comes into contact with said terminal on the bottom of apparatus;

wherein said movable arm is movable relative to said support between an extended position where said header is around the bottom of said apparatus when held upside down in said basin and a retracted position where said header is lower than at said extended position in the absence of said apparatus, and wherein, in said extended position, said apparatus is held upside down with said electric contact kept in electrical connection with said contact.

2. The cleaning device as set forth in claim 1, wherein said movable arm is slidable along an axis of said support.

3. The cleaning device as set forth in claim 1, wherein said movable arm is pivotally supported to said support so as to pivot around a horizontal axis.

4. The cleaning device as set forth in claim 1, wherein said header is pivotally supported to said arm so as to pivot in a forward direction in response to said hair removing apparatus being mourned to the stand while said header is at said extended position, thereby mating the contacts with the terminals on the bottom of said hair removing apparatus.

5. The cleaning device as set forth in claim 4, wherein said header is linked to a catch to be pressed by said hair removing apparatus, said catch being supported to said arm to move back and forth so that the rearward movement of the catch causes said header to pivot forwardly and downwardly for engagement of the contacts with said terminals on the bottom of said hair removing apparatus.

* * * * *